US007550202B2

(12) United States Patent
Pohlmann

(10) Patent No.: US 7,550,202 B2
(45) Date of Patent: Jun. 23, 2009

(54) INSULATION BOARD MADE OF A MIXTURE OF WOOD BASE MATERIAL AND BINDING FIBERS

(75) Inventor: Cevin Marc Pohlmann, Hoisdorf (DE)

(73) Assignee: Kronotec AG, Luzern (CH)

( * ) Notice: Subject to any disclaimer, the term of this patent is extended or adjusted under 35 U.S.C. 154(b) by 219 days.

(21) Appl. No.: 11/076,044

(22) Filed: Mar. 10, 2005

(65) Prior Publication Data

US 2005/0214537 A1 Sep. 29, 2005

(30) Foreign Application Priority Data

Mar. 11, 2004 (DE) ..... 10 2004 011 931

(51) Int. Cl.
*B32B 5/16* (2006.01)

(52) U.S. Cl. ..... 428/403; 428/407; 428/537.1; 427/212; 427/408; 106/282

(58) Field of Classification Search ..... 428/403, 428/407, 537.1; 427/212, 408; 106/282
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,776,188 | A | 9/1930 | Langb'aum |
| 1,778,069 | A | 10/1930 | Fetz |
| 1,779,729 | A | 10/1930 | Bruce |
| 1,787,027 | A | 12/1930 | Wasleff |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,921,164 | A | 8/1933 | Lewis |
| 1,929,871 | A | 10/1933 | Jones |
| 1,940,377 | A | 12/1933 | Storm |
| 1,946,648 | A | 2/1934 | Taylor |
| 1,953,306 | A | 4/1934 | Moratz |
| 1,986,739 | A | 1/1935 | Mitte |
| 1,988,201 | A | 1/1935 | Hall |
| 2,023,066 | A | 12/1935 | Curtis et al. |
| 2,044,216 | A | 6/1936 | Klages |
| 2,065,525 | A | 12/1936 | Hamilton |
| 2,123,409 | A | 7/1938 | Elmendorf |
| 2,220,606 | A | 11/1940 | Malarkey et al. |
| 2,276,071 | A | 3/1942 | Scull |
| 2,280,071 | A | 4/1942 | Hamilton |
| 2,324,628 | A | 7/1943 | Kähr |
| 2,328,051 | A | 8/1943 | Bull |
| 2,398,632 | A | 4/1946 | Frost et al. |
| 2,430,200 | A | 11/1947 | Wilson |
| 2,740,167 | A | 4/1956 | Rowley |
| 2,894,292 | A | 7/1959 | Gramelspacker |
| 3,045,294 | A | 7/1962 | Livezey, Jr. |
| 3,100,556 | A | 8/1963 | De Ridder |
| 3,125,138 | A | 3/1964 | Bolenbach |
| 3,182,769 | A | 5/1965 | De Ridder |
| 3,203,149 | A | 8/1965 | Soddy |
| 3,204,380 | A | 9/1965 | Smith et al. |
| 3,267,630 | A | 8/1966 | Omholt |

(Continued)

FOREIGN PATENT DOCUMENTS

| | | |
|---|---|---|
| AT | 005566 | 8/2002 |

(Continued)

OTHER PUBLICATIONS

Webster Dictionary, p. 862.

(Continued)

*Primary Examiner*—Leszek Kiliman
(74) *Attorney, Agent, or Firm*—Greenblum & Bernstein, P.L.C.

(57) ABSTRACT

The invention relates to an insulation material board composed of a wood material/binder fiber mixture and to a method for producing an insulation material board, in which an additive (3, 4) with a thermally resistant core (4) and with a thermally activatable coating (3) is added to the mixture, and the thermally activatable coating (3) is activated by the supply of heat.

22 Claims, 1 Drawing Sheet

U.S. PATENT DOCUMENTS

| | | | |
|---|---|---|---|
| 3,282,010 | A | 11/1966 | King, Jr. |
| 3,310,919 | A | 3/1967 | Bue et al. |
| 3,347,048 | A | 10/1967 | Brown et al. |
| 3,460,304 | A | 8/1969 | Braeuninger et al. |
| 3,481,810 | A | 12/1969 | Waite |
| 3,526,420 | A | 9/1970 | Brancaleone |
| 3,538,665 | A | 11/1970 | Gohner |
| 3,553,919 | A | 1/1971 | Omholt |
| 3,555,762 | A | 1/1971 | Costanzo, Jr. |
| 3,608,258 | A | 9/1971 | Spratt |
| 3,694,983 | A | 10/1972 | Couquet |
| 3,714,747 | A | 2/1973 | Curran |
| 3,720,027 | A | 3/1973 | Christensen |
| 3,731,445 | A | 5/1973 | Hoffmann et al. |
| 3,759,007 | A | 9/1973 | Thiele |
| 3,760,548 | A | 9/1973 | Sauer et al. |
| 3,768,846 | A | 10/1973 | Hensley et al. |
| 3,859,000 | A | 1/1975 | Webster |
| 3,878,030 | A | 4/1975 | Cook |
| 3,902,293 | A | 9/1975 | Witt et al. |
| 3,908,053 | A | 9/1975 | Hettich |
| 3,936,551 | A | 2/1976 | Elmendorf et al. |
| 3,988,187 | A | 10/1976 | Witt et al. |
| 4,006,048 | A | 2/1977 | Cannady, Jr. et al. |
| 4,044,087 | A | 8/1977 | Robitschek et al. |
| 4,090,338 | A | 5/1978 | Bourgade |
| 4,091,136 | A | 5/1978 | O'Brian et al. |
| 4,099,358 | A | 7/1978 | Compaan |
| 4,118,533 | A | 10/1978 | Hipchen et al. |
| 4,131,705 | A | 12/1978 | Kubinsky |
| 4,164,832 | A | 8/1979 | Van Zandt |
| 4,169,688 | A | 10/1979 | Toshio |
| 4,242,390 | A | 12/1980 | Nemeth |
| 4,243,716 | A | 1/1981 | Kosaka et al. |
| 4,245,689 | A | 1/1981 | Grard et al. |
| 4,246,310 | A | 1/1981 | Hunt et al. |
| 4,290,248 | A | 9/1981 | Kemerer et al. |
| 4,299,070 | A | 11/1981 | Oltmanns et al. |
| 4,426,820 | A | 1/1984 | Terbrack et al. |
| 4,431,044 | A | 2/1984 | Bruneau |
| 4,471,012 | A | 9/1984 | Maxwell |
| 4,501,102 | A | 2/1985 | Knowles |
| 4,561,233 | A | 12/1985 | Harter et al. |
| 4,585,685 | A | 4/1986 | Forry et al. |
| 4,612,745 | A | 9/1986 | Hovde |
| 4,641,469 | A | 2/1987 | Wood |
| 4,653,242 | A | 3/1987 | Ezard |
| 4,654,244 | A | 3/1987 | Eckert et al. |
| 4,703,597 | A | 11/1987 | Eggemar |
| 4,715,162 | A | 12/1987 | Brightwell |
| 4,738,071 | A | 4/1988 | Ezard |
| 4,752,497 | A | 6/1988 | McConkey et al. |
| 4,769,963 | A | 9/1988 | Meyerson |
| 4,819,932 | A | 4/1989 | Trotter, Jr. |
| 4,831,806 | A | 5/1989 | Niese et al. |
| 4,845,907 | A | 7/1989 | Meek |
| 4,905,442 | A | 3/1990 | Daniels |
| 4,947,602 | A | 8/1990 | Pollasky |
| 5,029,425 | A | 7/1991 | Bogataj |
| 5,103,614 | A | 4/1992 | Kawaguchi et al. |
| 5,113,632 | A | 5/1992 | Hanson |
| 5,117,603 | A | 6/1992 | Weintraub |
| 5,136,823 | A | 8/1992 | Pellegrino |
| 5,165,816 | A | 11/1992 | Parasin |
| 5,179,812 | A | 1/1993 | Itill |
| 5,205,091 | A | 4/1993 | Brown |
| 5,216,861 | A | 6/1993 | Meyerson |
| 5,251,996 | A | 10/1993 | Hiller et al. |
| 5,253,464 | A | 10/1993 | Nilsen |
| 5,283,102 | A | 2/1994 | Sweet et al. |
| 5,295,341 | A | 3/1994 | Kajiwara |
| 5,335,473 | A | 8/1994 | Chase |
| 5,348,778 | A | 9/1994 | Knipp et al. |
| 5,349,796 | A | 9/1994 | Meyerson |
| 5,390,457 | A | 2/1995 | Sjölander |
| 5,413,834 | A | 5/1995 | Hunter et al. |
| 5,433,806 | A | 7/1995 | Pasquali et al. |
| 5,474,831 | A | 12/1995 | Nystrom |
| 5,497,589 | A | 3/1996 | Porter |
| 5,502,939 | A | 4/1996 | Zadok et al. |
| 5,540,025 | A | 7/1996 | Takehara et al. |
| 5,567,497 | A | 10/1996 | Zegler et al. |
| 5,570,554 | A | 11/1996 | Searer |
| 5,597,024 | A | 1/1997 | Bolyard et al. |
| 5,630,304 | A | 5/1997 | Austin |
| 5,653,099 | A | 8/1997 | MacKenzie |
| 5,671,575 | A | 9/1997 | Wu |
| 5,694,734 | A | 12/1997 | Cercone et al. |
| 5,706,621 | A | 1/1998 | Pervan |
| 5,736,227 | A | 4/1998 | Sweet et al. |
| 5,749,954 | A | 5/1998 | Law et al. |
| 5,768,850 | A | 6/1998 | Chen |
| 5,797,175 | A | 8/1998 | Schneider |
| 5,797,237 | A | 8/1998 | Finkell, Jr. |
| 5,823,240 | A | 10/1998 | Bolyard et al. |
| 5,827,592 | A | 10/1998 | Van Gulik et al. |
| 5,860,267 | A | 1/1999 | Pervan |
| 5,935,668 | A | 8/1999 | Smith |
| 5,943,239 | A | 8/1999 | Shamblin et al. |
| 5,953,878 | A | 9/1999 | Johnson |
| 5,968,625 | A | 10/1999 | Hudson |
| 5,985,397 | A | 11/1999 | Witt et al. |
| 5,987,839 | A | 11/1999 | Hamar et al. |
| 6,006,486 | A | 12/1999 | Moriau et al. |
| 6,023,907 | A | 2/2000 | Pervan |
| 6,065,262 | A | 5/2000 | Motta |
| 6,094,882 | A | 8/2000 | Pervan |
| 6,101,778 | A | 8/2000 | Martensson |
| 6,119,423 | A | 9/2000 | Costantino |
| 6,134,854 | A | 10/2000 | Stanchfield |
| 6,148,884 | A | 11/2000 | Bolyard et al. |
| 6,168,866 | B1 | 1/2001 | Clark |
| 6,182,410 | B1 | 2/2001 | Pervan |
| 6,186,703 | B1 | 2/2001 | Shaw |
| 6,205,639 | B1 | 3/2001 | Pervan |
| 6,209,278 | B1 | 4/2001 | Tychsen |
| 6,216,403 | B1 | 4/2001 | Belbeoc'h |
| 6,216,409 | B1 | 4/2001 | Roy et al. |
| D442,296 | S | 5/2001 | Külik |
| D442,297 | S | 5/2001 | Külik |
| D442,298 | S | 5/2001 | Külik |
| D442,706 | S | 5/2001 | Külik |
| D442,707 | S | 5/2001 | Külik |
| 6,224,698 | B1 | 5/2001 | Endo |
| 6,238,798 | B1 | 5/2001 | Kang et al. |
| 6,247,285 | B1 | 6/2001 | Moebus |
| D449,119 | S | 10/2001 | Külik |
| D449,391 | S | 10/2001 | Külik |
| D449,392 | S | 10/2001 | Külik |
| 6,324,803 | B1 | 12/2001 | Pervan |
| 6,345,481 | B1 | 2/2002 | Nelson |
| 6,363,677 | B1 | 4/2002 | Chen et al. |
| 6,397,547 | B1 | 6/2002 | Martensson |
| 6,418,683 | B1 | 7/2002 | Martensson et al. |
| 6,421,970 | B1 | 7/2002 | Martensson et al. |
| 6,427,408 | B1 | 8/2002 | Krieger |
| 6,436,159 | B1 | 8/2002 | Safta et al. |
| 6,438,919 | B1 | 8/2002 | Knauseder |
| 6,446,405 | B1 | 9/2002 | Pervan |
| 6,449,913 | B1 | 9/2002 | Shelton |
| 6,449,918 | B1 | 9/2002 | Nelson |
| 6,453,632 | B1 | 9/2002 | Huang |
| 6,458,232 | B1 | 10/2002 | Valentinsson |
| 6,460,306 | B1 | 10/2002 | Nelson |

| | | | |
|---|---|---|---|
| 6,461,636 | B1 | 10/2002 | Arth et al. |
| 6,465,046 | B1 | 10/2002 | Hansson et al. |
| 6,490,836 | B1 | 12/2002 | Moriau et al. |
| 6,497,961 | B2 | 12/2002 | Kang et al. |
| 6,510,665 | B2 | 1/2003 | Pervan |
| 6,516,579 | B1 | 2/2003 | Pervan |
| 6,517,935 | B1 | 2/2003 | Kornfalt et al. |
| 6,519,912 | B1 | 2/2003 | Eckmann et al. |
| 6,521,314 | B2 | 2/2003 | Tychsen |
| 6,532,709 | B2 | 3/2003 | Pervan |
| 6,533,855 | B1 | 3/2003 | Gaynor et al. |
| 6,536,178 | B1 | 3/2003 | Pålsson et al. |
| 6,546,691 | B2 | 4/2003 | Peopolder |
| 6,553,724 | B1 | 4/2003 | Bigler |
| 6,558,754 | B1 | 5/2003 | Velin et al. |
| 6,565,919 | B1 | 5/2003 | Hansson et al. |
| 6,569,272 | B2 | 5/2003 | Tychsen |
| 6,588,166 | B2 | 7/2003 | Martensson et al. |
| 6,591,568 | B1 | 7/2003 | Palsson |
| 6,601,359 | B2 | 8/2003 | Olofsson |
| 6,606,834 | B2 | 8/2003 | Martensson et al. |
| 6,617,009 | B1 | 9/2003 | Chen et al. |
| 6,635,174 | B1 | 10/2003 | Berg et al. |
| 6,641,629 | B2 | 11/2003 | Safta et al. |
| 6,646,088 | B2 | 11/2003 | Fan et al. |
| 6,647,690 | B1 | 11/2003 | Martensson |
| 6,649,687 | B1 | 11/2003 | Gheewala et al. |
| 6,659,097 | B1 | 12/2003 | Houston |
| 6,672,030 | B2 | 1/2004 | Schulte |
| 6,675,545 | B2 | 1/2004 | Chen et al. |
| 6,681,820 | B2 | 1/2004 | Olofsson |
| 6,682,254 | B1 | 1/2004 | Olofsson et al. |
| 6,685,993 | B1 | 2/2004 | Hansson et al. |
| 6,711,864 | B2 | 3/2004 | Erwin |
| 6,711,869 | B2 | 3/2004 | Tychsen |
| 6,715,253 | B2 | 4/2004 | Pervan |
| 6,723,438 | B2 | 4/2004 | Chang et al. |
| 6,729,091 | B1 | 5/2004 | Martensson |
| 6,745,534 | B2 | 6/2004 | Kornfalt |
| 6,761,008 | B2 | 7/2004 | Chen et al. |
| 6,761,794 | B2 | 7/2004 | Mott et al. |
| 6,763,643 | B1 | 7/2004 | Martensson |
| 6,766,622 | B1 | 7/2004 | Thiers |
| 6,769,217 | B2 | 8/2004 | Nelson |
| 6,769,218 | B2 | 8/2004 | Pervan |
| 6,769,835 | B2 | 8/2004 | Stridsman |
| 6,772,568 | B2 | 8/2004 | Thiers et al. |
| 6,786,019 | B2 | 9/2004 | Thiers |
| 6,803,109 | B2 | 10/2004 | Qiu et al. |
| 6,805,951 | B2 | 10/2004 | Kornfält et al. |
| 6,823,638 | B2 | 11/2004 | Stanchfield |
| 6,841,023 | B2 | 1/2005 | Mott |
| 2001/0029720 | A1 | 10/2001 | Pervan |
| 2001/0034992 | A1 | 11/2001 | Pletzer et al. |
| 2002/0007608 | A1 | 1/2002 | Pervan |
| 2002/0007609 | A1 | 1/2002 | Pervan |
| 2002/0014047 | A1 | 2/2002 | Thiers |
| 2002/0020127 | A1 | 2/2002 | Thiers et al. |
| 2002/0046528 | A1 | 4/2002 | Pervan et al. |
| 2002/0056245 | A1 | 5/2002 | Thiers |
| 2002/0106439 | A1 | 8/2002 | Cappelle |
| 2002/0106680 | A1 | 10/2002 | Laurence et al. |
| 2003/0024200 | A1 | 2/2003 | Moriau et al. |
| 2003/0024201 | A1 | 2/2003 | Moriau et al. |
| 2003/0029115 | A1 | 2/2003 | Moriau et al. |
| 2003/0029116 | A1 | 2/2003 | Moriau et al. |
| 2003/0029117 | A1 | 2/2003 | Moriau et al. |
| 2003/0033777 | A1 | 2/2003 | Thiers et al. |
| 2003/0033784 | A1 | 2/2003 | Pervan |
| 2003/0115812 | A1 | 6/2003 | Pervan |
| 2003/0115821 | A1 | 6/2003 | Pervan |
| 2003/0159385 | A1 | 8/2003 | Thiers |
| 2003/0167717 | A1 | 9/2003 | Garcia |
| 2003/0196405 | A1 | 10/2003 | Pervan |
| 2003/0205013 | A1 | 11/2003 | Garcia |
| 2003/0233809 | A1 | 12/2003 | Pervan |
| 2004/0016196 | A1 | 1/2004 | Pervan |
| 2004/0035078 | A1 | 2/2004 | Pervan |
| 2004/0092006 | A1 | 5/2004 | Lindekens et al. |
| 2004/0105994 | A1 | 6/2004 | Lu et al. |
| 2004/0139678 | A1 | 7/2004 | Pervan |
| 2004/0159066 | A1 | 8/2004 | Thiers et al. |
| 2004/0177584 | A1 | 9/2004 | Pervan |
| 2004/0200165 | A1 | 10/2004 | Garcia et al. |
| 2004/0206036 | A1 | 10/2004 | Pervan |
| 2004/0237447 | A1 | 12/2004 | Thiers et al. |
| 2004/0237448 | A1 | 12/2004 | Thiers et al. |
| 2004/0241374 | A1 | 12/2004 | Thiers et al. |
| 2004/0244322 | A1 | 12/2004 | Thiers et al. |
| 2004/0250493 | A1 | 12/2004 | Thiers et al. |
| 2004/0255541 | A1 | 12/2004 | Thiers et al. |
| 2004/0258907 | A1 | 12/2004 | Kornfalt et al. |
| 2005/0003149 | A1 | 1/2005 | Kornfalt et al. |
| 2005/0016099 | A1 | 1/2005 | Thiers |

FOREIGN PATENT DOCUMENTS

| | | |
|---|---|---|
| AU | 713628 | 5/1998 |
| AU | 200 020703 | 1/2000 |
| BE | 417526 | 9/1936 |
| BE | 557844 | 6/1957 |
| BE | 557844 | 3/1960 |
| BE | 09 600527 | 6/1998 |
| BE | 09 700344 | 10/1998 |
| CA | 991373 | 6/1976 |
| CA | 2226286 | 12/1997 |
| CA | 2252791 | 5/1999 |
| CA | 2 289309 | 7/2000 |
| CH | 200949 | 1/1939 |
| CH | 211877 | 1/1941 |
| CH | 562377 | 5/1975 |
| DE | 314207 | 9/1919 |
| DE | 531989 | 8/1931 |
| DE | 740235 | 10/1943 |
| DE | 1089966 | 9/1960 |
| DE | 1534278 | 2/1966 |
| DE | 1212225 | 3/1966 |
| DE | 1212275 | 3/1966 |
| DE | 1534802 | 4/1970 |
| DE | 7 102476 | 6/1971 |
| DE | 7102476 | 6/1971 |
| DE | 2007129 | 9/1971 |
| DE | 1534278 | 11/1971 |
| DE | 2106690 | 9/1972 |
| DE | 2 252643 | 10/1972 |
| DE | 2238660 | 2/1974 |
| DE | 7402354 | 5/1974 |
| DE | 2448319 | 4/1976 |
| DE | 2502992 | 7/1976 |
| DE | 2616077 | 10/1977 |
| DE | 2917025 | 11/1980 |
| DE | 7911924 | 3/1981 |
| DE | 7928703 | 5/1981 |
| DE | 3041781 | 6/1982 |
| DE | 3214207 | 11/1982 |
| DE | 8226153 | 1/1983 |
| DE | 3343601 | 6/1985 |
| DE | 86 040049 | 6/1986 |
| DE | 3512204 | 10/1986 |
| DE | 3 246376 | 2/1987 |
| DE | 4004891 | 9/1990 |
| DE | 4002547 | 8/1991 |
| DE | 4134452 | 4/1993 |
| DE | 4215273 | 11/1993 |
| DE | 4242530 | 6/1994 |
| DE | 4011656 | 1/1995 |

| | | |
|---|---|---|
| DE | 4324137 | 1/1995 |
| DE | 4107151 | 2/1995 |
| DE | 29 517128 | 2/1996 |
| DE | 4242530 | 9/1996 |
| DE | 3544845 | 12/1996 |
| DE | 29 710175 | 9/1997 |
| DE | 19 616510 | 3/1998 |
| DE | 19 651149 | 6/1998 |
| DE | 19 709641 | 9/1998 |
| DE | 19 718319 | 11/1998 |
| DE | 19 735189 | 6/2000 |
| DE | 20 001225 | 8/2000 |
| DE | 19 925248 | 12/2000 |
| DE | 20 017461 | 3/2001 |
| DE | 20 018284 | 3/2001 |
| DE | 10022008 | 11/2001 |
| DE | 10056829 | 6/2002 |
| DE | 20 206460 | 8/2002 |
| DE | 20 218331 | 5/2004 |
| EP | 0 248127 | 12/1987 |
| EP | 0248127 | 12/1987 |
| EP | 0623724 | 11/1994 |
| EP | 0652340 | 5/1995 |
| EP | 0667936 | 8/1995 |
| EP | 0690185 | 1/1996 |
| EP | 0849416 | 6/1998 |
| EP | 0698162 | 9/1998 |
| EP | 0903451 | 3/1999 |
| EP | 0855482 | 12/1999 |
| EP | 0877130 | 1/2000 |
| EP | 0969163 | 1/2000 |
| EP | 0969164 | 1/2000 |
| EP | 0974713 | 1/2000 |
| EP | 1038898 | 9/2000 |
| EP | 1038898 A1 * | 9/2000 |
| EP | 0843763 | 10/2000 |
| EP | 1200690 | 5/2002 |
| EP | 0958441 | 7/2003 |
| EP | 1026341 | 8/2003 |
| ES | 163421 | 9/1968 |
| ES | 460194 | 5/1978 |
| ES | 283331 | 5/1985 |
| ES | 1019585 | 12/1991 |
| ES | 1019585 | 1/1992 |
| ES | 2168045 | 5/2002 |
| FI | 843060 | 8/1984 |
| FR | 1293043 | 4/1962 |
| FR | 2691491 | 11/1983 |
| FR | 2568295 | 5/1986 |
| FR | 2623544 | 5/1989 |
| FR | 2630149 | 10/1989 |
| FR | 2637932 | 4/1990 |
| FR | 2675174 | 10/1991 |
| FR | 2667639 | 4/1992 |
| FR | 2691491 | 11/1993 |
| FR | 2697275 | 4/1994 |
| FR | 2712329 | 5/1995 |
| FR | 2776956 | 10/1999 |
| FR | 2781513 | 1/2000 |
| FR | 2785633 | 5/2000 |
| GB | 424057 | 2/1935 |
| GB | 585205 | 1/1947 |
| GB | 599793 | 3/1948 |
| GB | 636423 | 4/1950 |
| GB | 812671 | 4/1959 |
| GB | 1033866 | 6/1966 |
| GB | 1034117 | 6/1966 |
| GB | 1044846 | 10/1966 |
| GB | 1237744 | 6/1968 |
| GB | 1127915 | 9/1968 |
| GB | 1275511 | 5/1972 |
| GB | 1399402 | 7/1975 |
| GB | 1430423 | 3/1976 |
| GB | 2117813 | 10/1983 |
| GB | 2126106 | 3/1984 |
| GB | 2152063 | 7/1985 |
| GB | 2238660 | 6/1991 |
| GB | 2243381 | 10/1991 |
| GB | 2256023 | 11/1992 |
| JP | 54-65528 | 5/1979 |
| JP | 57-119056 | 7/1982 |
| JP | 59-186336 | 10/1984 |
| JP | 3-169967 | 7/1991 |
| JP | 4-106264 | 4/1992 |
| JP | 5-148984 | 6/1993 |
| JP | 6-56310 | 5/1994 |
| JP | 6-146553 | 5/1994 |
| JP | 6-200611 | 7/1994 |
| JP | 6-320510 | 11/1994 |
| JP | 7-76923 | 3/1995 |
| JP | 7-180333 | 7/1995 |
| JP | 7-300979 | 11/1995 |
| JP | 7-310426 | 11/1995 |
| JP | 8-109734 | 4/1996 |
| JP | 8-270193 | 10/1996 |
| NE | 7 601773 | 2/1976 |
| NO | 157871 | 2/1988 |
| NO | 305614 | 6/1999 |
| SE | 711 4900-9 | 9/1974 |
| SE | 450411 | 6/1987 |
| SE | 450141 | 9/1987 |
| SE | 501014 | 10/1994 |
| SE | 501914 | 6/1995 |
| SE | 502994 | 4/1996 |
| SE | 506254 | 11/1997 |
| SE | 509059 | 11/1998 |
| SE | 509060 | 11/1998 |
| SE | 512290 | 2/2000 |
| SE | 512313 | 2/2000 |
| SE | 0000200-6 | 8/2001 |
| SU | 363795 | 12/1972 |
| WO | 84/02155 | 6/1984 |
| WO | 87/03839 | 7/1987 |
| WO | 89/08539 | 9/1989 |
| WO | 92/17657 | 10/1992 |
| WO | 93/13280 | 7/1993 |
| WO | 93/19910 | 10/1993 |
| WO | 94/01628 | 1/1994 |
| WO | 94/26999 | 11/1994 |
| WO | 94 126999 | 11/1994 |
| WO | 95/06176 | 3/1995 |
| WO | 96/27719 | 9/1996 |
| WO | 96/27721 | 9/1996 |
| WO | 96/30177 | 10/1996 |
| WO | 97/47834 | 12/1997 |
| WO | 98/24495 | 6/1998 |
| WO | 98/24994 | 6/1998 |
| WO | 98/38401 | 9/1998 |
| WO | 99 140273 | 8/1999 |
| WO | 99/66151 | 12/1999 |
| WO | 99 166152 | 12/1999 |
| WO | 00 106854 | 2/2000 |
| WO | 00 166856 | 11/2000 |
| WO | 01 166876 | 9/2001 |

OTHER PUBLICATIONS

Opposition II EPO. 698. 162—Facts—Arguments Evidence (11 pages)- translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc.* et al. vs. *International Trade Commission and Pergs, Inc.* et al. decided Sep. 10, 2003.

* cited by examiner

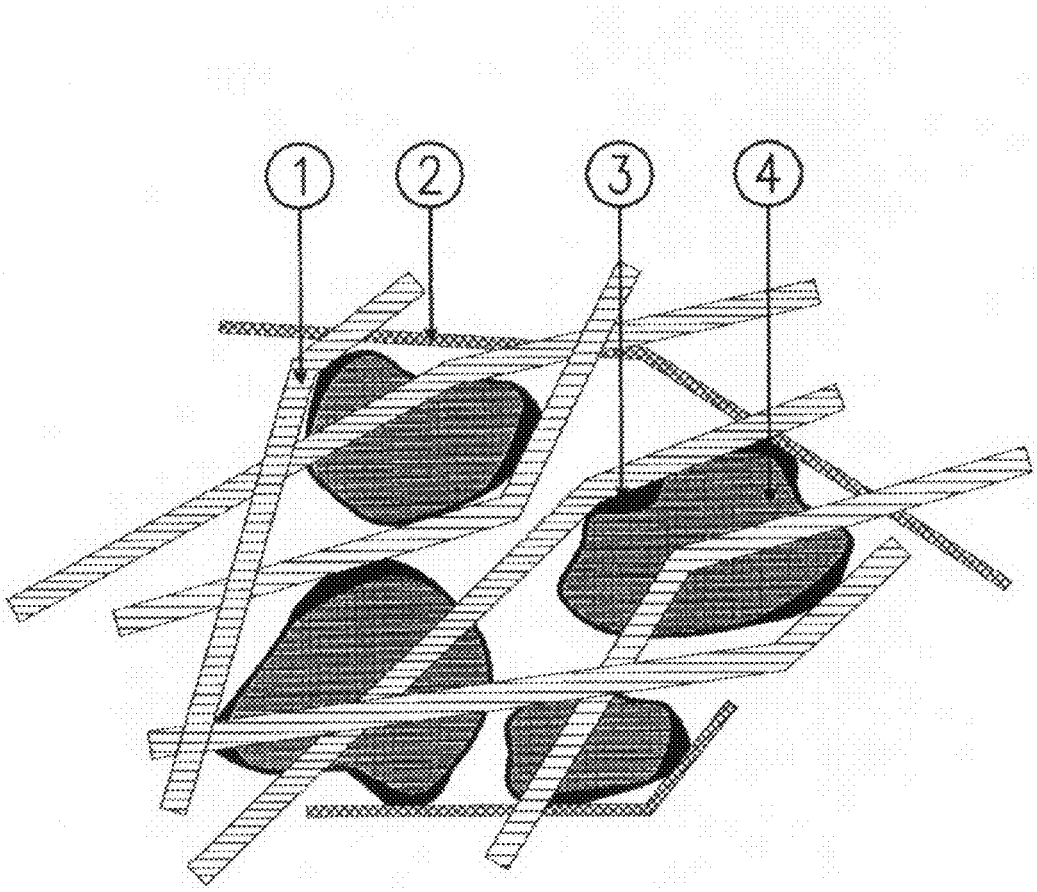
1
2
3
4

INSULATION BOARD MADE OF A MIXTURE OF WOOD BASE MATERIAL AND BINDING FIBERS

FIELD OF THE INVENTION

The invention relates to an insulation material board composed of wood material/binder fiber mixture, to a method for producing an insulation material board and to an additive for improving the compressive strength and improving the structure of insulation material boards composed of a wood material/binder fiber mixture.

BACKGROUND DESCRIPTION

The production of insulation materials from fibers, for example fibers of wood, of flax, of hemp or of wool or the like, if appropriate with the addition of thermo-plastic binder fibers, is known. The production of these insulation materials and fleeces is carried out by the dry method, for example by means of aerodynamic fleece folding methods with a spatial orientation of the fiber/binder fiber matrix in a drum opening and distributing the fiber stock and with a subsequent thermal consolidation of the fiber/binder fiber matrix in a hot-air throughflow dryer. This is described, for example in DE 100 56 829 A1.

Where wood fiber insulation materials are concerned, the production of the insulation materials boards may also be carried out by the wet method with a subsequent hot-pressing method.

In the previous methods for the production of insulation materials from natural and synthetic fibers, there is still often an insufficient spatial orientation of the wood fibers and binder fibers. On account of the predominantly parallel orientation of the fibers, these insulation material boards can easily be split perpendicularly to the surfaces of the board in spite of thermal consolidation in the hot-air throughflow dryer. Moreover, the compressive strength of these insulation material boards is relatively low because of the low bulk density.

The result of this is that the use of such boards as insulation material and plaster base, particularly on the outside, presents problems, since the insulation materials having low compressive strength and low transverse tensile strength have to be fastened to the substrate by special fastening means. Moreover, too low a compressive strength has an adverse effect on the impact resistance of the composite heat insulation system.

To achieve a sufficient structural strength of the insulation material board, binder fibers are used, which, as a rule, consist of a polyester or of a polypropylene core with thicknesses of 2.2 to 4.4 detex in which are added in a proportion of up to 25 percent by weight. Since the costs of these binder fibers are relatively high in comparison with wood fibers, such insulation materials are comparatively costly. Furthermore, the addition of binder fibers has only a limited improving effect in increasing the compressive strength. An optimum bulk density for a wood fiber board as a plaster base board is approximately 100 kg/m$^3$. Higher bulk densities have an adverse effect on the thermal conductivity of the insulation plate, in such a way that the required thermal conductivity group WLG 040 is not achieved, but, on the other hand, increased stability is achieved.

SUMMARY OF THE INVENTION

The object of the present invention is to provide an insulation material board, an additive for an insulation material board and a method for producing an insulation material board, by means of which the compressive strength and structural strength of insulation material boards composed of wood materials, in particular of wood fibers, with low bulk densities can be increased cost-effectively.

This object is achieved, according to the invention, by means of an insulation material board which is composed of a wood material/binder fiber mixture and in which an additive composed of a thermally resistant core is added to the mixture, the core being provided with a thermally activatable coating.

Advantageously, the core consists of perlite or of a thermosetting plastic material, thus resulting in an improvement in the moisture resistance of the insulation material board on account of the hydrophobic properties of the additive. This arises due to a mass of hydrophilic wood materials, in particular wood fibers, which is reduced according to the addition of the additive.

Furthermore, there is provision for the core to take the form of granulate or of a fiber material, in order to come into contact with as many wood material components or wood fibers and also binder fibers as possible.

To increase the compressive strength and transverse tensile strength, the dry wood fiber/binder fiber mixture has added to it a fine-grained granulate or fine-grained particles composed of bituminized perlite, of different thermoplastic groups, of thermoplastically encased thermosetting plastic groups or of comparable particles with a thermally resistant core and with a thermally activatable or thermoplastic casing. The grain sizes of the additives are in this case between 0.3 and 2.5 mm.

To increase the compressive and structural strength, the proportion of the additive in relation to the overall mass of the wood material/binder fiber mixture is at least 20%, but may even be 40% or more.

Advantageously, the additive is distributed homogeneously within the wood material/binder fiber mixture, in order to ensure a uniform compressive and structural strength of the insulation material board.

In contrast to the hydrophilic wood materials, there is provision for the additive to be hydrophobic, so that a higher moisture resistance of the insulation material board is achieved in addition to the improved compressive strength.

The insulation material board preferably has a bulk density of more than 20 kg/m$^3$, but may even have a bulk density of above 100 kg/m$^3$, in order to have, on the one hand, optimum strength and, on the other hand, optimum thermal conductivity, so that, when it is used as a stable plaster base, good insulation is ensured.

By the additive being used, the proportion of the binder fibers can be reduced to approximately 10 percent by weight in relation to the overall mass of the insulation material board, thus reducing the costs of the insulation material board.

The additive according to the invention for improving the compressive strength and improving the structure of insulation material boards composed of a wood material/binder fiber mixture provides a thermally resistant core and a thermally activatable coating, so that both the wood materials and the binder fibers can be connected to the additive by the supply of energy. The supply of heat takes place, for example, by means of a hot-air throughflow dryer, hot-steam throughflow or HF heating. Other heating possibilities are likewise provided, for example by means of heated press plates.

The thermally activatable coating is preferably a thermoplastic or bitumen, and other thermally activatable coatings may likewise be arranged on a corresponding core, in order bring about a cross-linking of the wood materials and binder fibers with the additive.

The coating may surround the core completely, but alternatively only a partial coating of the surface of the core is provided.

The core consists of a granulate, for example of perlite or of another mineral basic material or of a fiber, while, alternatively to a mineral material, the core may also consist of a thermosetting plastic. It is likewise possible, in coordination with the process management, to employ a thermoplastic which remains dimensionally stable at the prevailing temperatures.

Advantageously, the additive may be a mixed plastic which, in addition to thermosetting plastic fractions, also has thermoplastic fractions. Mixed plastics of this type are, for example, products of the Dual System (DS) with average fractions of 50 to 70% polyolefins, 15 to 20% polystyrene, 5 to 15% PET and 1 to 5% of other packaging plastics. Such mixed plastics are produced by dry preparation methods, in particular mixed plastics from household garbage being used. The initial material is first comminuted in a comminution stage, magnetic substances are removed from the comminuted material, and the comminuted material is thermally agglomerated or compacted under pressure, that is to say press-agglomerated. During the agglomerating operation, volatile substances, water vapor, ash and paper can be suction-extracted by means of suction extraction devices.

The agglomerated material is subsequently dried to a desired residual moisture and screened. As a result of the agglomeration process, thermoplastic constituents, for example polyethylene (LDPE, HDPE) and thermosetting plastic constituents, for example polyesters or polyurethanes, are connected to form a granulate-like material. In this case, a thermosetting core composed, for example, of polyurethane is surrounded completely or partially by a thermally activatable thermoplastic casing composed, for example, of polyethylene, or a thermoplastic core melting at high temperatures is surrounded by a casing melting at low temperatures.

Mixed plastics agglomerated in this way have a sufficiently high proportion of thermally activatable (thermoplastic) fractions and of thermosetting constituents and are therefore particularly suitable as an additive for improving the compressive strength and improving the structure and/or as a binder for an insulation material board, since the thermoplastic casing of the additive can be thermally activated by means of the supply of sufficient temperature, for example in a hot-pressing operation. Advantageously, mixed plastics agglomerated in this way can be added to wood material fibers and known binder fibers on insulation material production lines, since the agglomerated mixed plastics have thermally activatable constituents which are activated by pressure and temperature for the production of insulation material boards, the thermosetting cores or the thermoplastic cores remaining stable. For this purpose, the press temperature is to be set in such a way that it is always lower than the melting temperature or the decomposition temperature of the core materials.

By agglomerated mixed plastic being added to the production of the insulation material boards, improved compressive strength and transverse tensile strength values of the boards can be achieved, without the proportion of costly binder fibers (with a polypropylene core and a polyethylene casing) having to be increased. Advantageously, the increase in the strength properties is possible solely by the addition of cost-effective agglomerated mixed plastics which originate from the Dual System.

The additive is hydrophobic, in order to improve moisture resistance.

In the method for producing an insulation material board with a wood material/binder fiber mixture, an additive with a thermally resistant core and with a thermally activatable coating is added to the mixture. The thermally activatable coating is activated by the supply of heat, so that the wood material/binder fiber mixture and the additive are cross-linked with one another. An insulation material board is thereby provided, which comes within the optimum bulk density range of approximately 100 kg/m$^3$ and in this case has sufficient compressive strength and transverse tensile strength, at the same time with moisture resistance.

The coating of the core is in this case activated in a hot-air stream, although alternative activation methods, for example by heated rollers, HF heating or infrared emitters, are likewise possible.

For the uniform intermixing of the wood materials and of the binder fibers, these are mixed in an aerodynamic fleece forming machine, and the additive is subsequently admixed in a separate fleece forming machine. In this case, the spatial orientation of the fiber matrix is also carried out, this taking place in a separate aerodynamic fleece forming machine.

A uniform formation of the structure of the insulation material board is carried out by means of a homogeneous distribution of the additive within the wood material/binder fiber mixture.

BRIEF DESCRIPTION OF THE DRAWINGS

The invention is explained in more detail below with reference to the single FIGURE.

DETAILED DESCRIPTION OF EMBODIMENTS OF THE INVENTION

The FIGURE shows the embedding of an additive into a wood fiber/binder fiber matrix.

The FIGURE illustrates a mixture of wood fibers 1 and of binder fibers 2 which are intermixed homogeneously in a first aerodynamic fleece forming machine. Alternatively to wood fibers 1, other wood materials, for example wood chips or the like, may also be used, for example also alternative raw materials, such as hemp, wool, flax or other renewable raw materials.

An admixing of an improving additive subsequently takes place, the latter consisting of a core 4 with a thermally activatable coating 3. This thermally activatable coating 3 may consist, for example, of bitumen or of a thermoplastic. This coating 3 may either surround the core 4 completely or be arranged only partially on the surface of the latter.

The additive 3, 4 is added to the dry mixture of wood fibers 1 and of binder fibers 2 as a fine-grained granulate or as particles composed of corresponding materials, such as bituminized perlites, coated thermo-plastic groups or thermoplastically encased thermo-setting groups. The grain sizes of the additive 3, 4 should be 0.3-2.5 mm, preferably 0.5-2 mm, for this intended use. To increase the compressive or structural strength, the proportion of the additive in the overall mass of the insulation board should be at least 20%, but even values of above 40% are possible.

The admixing of the additive 3, 4 and the spatial orientation of the fiber matrix take place, after the intermixing of the wood fibers 1 and binder fibers 2, in a separate second aerodynamic fleece forming machine. Owing to the addition of the additive 3, 4 along with the additional connecting action of the thermally activatable coating 3, the proportion of binder fibers 2 in the overall weight can be lowered to 10%.

Owing to the aerodynamic fleece or fiber folding method with spatial orientation, the particles of the additive 3, 4 are distributed homogeneously within the matrix of the wood fibers and binder fibers 1, 2. Activation advantageously takes place in a hot-air throughflow dryer, so that, as a result of the heat supplied to the thermoplastic casings 3 of the core 4, the additive particles form additional contact points with the wood fibers 1 and with the binder fibers 2. A fiber/binder additive matrix having compressive strength and improved structural strength is thereby provided.

The insulation materials improved by means of the additive 3, 4 may be employed as heat insulation material on the outside, for example for composite heat insulation systems and as impact sound insulation materials in the floor area, for example under laminate or finished parquet floors.

EXAMPLE 1

Heat insulation material board for heat insulation with a target bulk density of 100 kg/m$^3$ and with a thickness of 100 mm by the addition of the additive.

Apparent density overall 10.056 g/m$^2$, proportion of the additive composed of various thermoplastic groups 3.394 g/m$^2$ (proportion 60% in relation to absolutely dry wood fibers), proportion of the binder fiber 1.006 g/m$^2$ (10%), proportion of wood fibers 5.656 g/m$^2$, intermixing and folding of the fiber fleece in a drum, activation of the thermoplastic constituent in a hot-air throughflow dryer at 170° C.

EXAMPLE 2

Insulation material board for impact sound insulation, target bulk density 135 kg/m$^3$ and with a thickness of 6 mm by the addition of the additive:

Apparent density overall 800 g/m$^2$, proportion of the additive composed of various thermoplastic groups 206 g/m$^2$ (proportion 40% in relation to absolutely dry wood fibers), proportion of the binder fiber [illegible] g/m$^2$ (10%), proportion of wood fibers 514 g/m$^2$, intermixing and folding of the fiber fleece in a drum, activation of the thermoplastic constituents in a hot-air throughflow dryer at 170° C.

KS/DV/dg-us

The invention claimed is:

1. An insulation material board composed of a wood fiber material/binder fiber mixture with a bulk density of at least 20 kg/m$^3$, comprising an additive having thermosetting and thermoplastic portions in granular form, wherein the thermosetting portion forms a core and the thermoplastic portion forms a thermally activatable coating that at least partially encloses the core.

2. The insulation material board according to claim 1, wherein the core is formed from perlite or thermosetting plastic material.

3. The insulation material board according to claim 1, wherein the core takes the form of granulate or fiber material.

4. The insulation material board according to claim 1, wherein the additive has a grain size of 0.3 to 2.5 mm.

5. The insulation material board according to claim 1, wherein a proportion of the additive in relation to an overall mass of the insulation material board is at least 20%.

6. The insulation material board according claim 1, wherein the additive is distributed homogeneously within the wood fiber material/binder fiber mixture.

7. The insulation material board according claim 1, wherein the additive is hydrophobic.

8. The insulation material board according to claim 1, comprising binder fibers, wherein a proportion of the binder fibers is between 10 and 20 percent by weight of the overall mass.

9. Additive for improving the compressive strength and improving the structure of insulation material boards composed of a wood fiber material/binder fiber mixture, comprising an additive having thermosetting plastic and thermoplastic portions in granular form, wherein in granules of the additive the thermo setting plastic portion forms a core and the thermoplastic portion forms a thermally activatable coating that at least partially encloses the core.

10. The additive according to claim 9, wherein the thermally activatable coating is a thermoplastic or bitumen.

11. The additive according to claim 9, wherein the thermally activatable coating completely surrounds the core.

12. The additive according to claim 9, wherein the core comprises a granulate or a fiber.

13. The additive according to claim 9, wherein the thermosetting plastic portion comprises polyester or polyurethane.

14. The additive according to claim 9, wherein the additive is hydrophobic.

15. Method for producing an insulation material board composed of a wood fiber material/binder fiber mixture with a bulk density of at least 20 kg/m$^3$, comprising:

mixing the wood fiber material/binder fiber mixture in an aerodynamic fleece forming machine to form a first fleece;

admixing to the first fleece an additive composed of thermosetting and thermoplastic portions in granular form, wherein the thermosetting portion forms a core and the thermoplastic portion forms a thermally activatable coating that at least partially encloses the core; and thermally activating the thermally activatable coating to cross-link the additive with the wood fiber material/binder fiber mixture to form the insulation material board.

16. The method according to claim 15, wherein the thermally activatable coating is activated in a hot-air stream.

17. The method according to claim 15, wherein admixing of the additive and a spatial orientation of the fiber matrix take place in a separate fleece forming machine.

18. The method according to claim 15, wherein the additive is distributed homogeneously within the wood fiber material/binder fiber mixture.

19. The insulation material board according to claim 1, wherein the thermally activatable coating completely surrounds the core.

20. The additive according to claim 9, wherein a grain size of the additive is in a range of 0.3 mm to 2.5 mm.

21. The insulation material board according to claim 1, wherein the binder fiber comprises thermoplastic binder fibers.

22. The method according to claim 15, wherein the first fleece is a dry mixture of the wood fibers and the binder fibers.

* * * * *